US007297225B2

(12) United States Patent
Thomas et al.

(10) Patent No.: US 7,297,225 B2
(45) Date of Patent: Nov. 20, 2007

(54) PROCESS FOR HIGH TEMPERATURE PEROXIDE BLEACHING OF PULP WITH COOL DISCHARGE

(75) Inventors: Hazen Charles Thomas, Green Bay, WI (US); Wayne F. Winkler, DePere, WI (US); Jeffrey A. Lee, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 10/872,450

(22) Filed: Jun. 22, 2004

(65) Prior Publication Data

US 2005/0279467 A1 Dec. 22, 2005

(51) Int. Cl.
*D21C 9/10* (2006.01)
*D21C 9/02* (2006.01)
*D21C 9/18* (2006.01)

(52) U.S. Cl. ..... 162/43; 162/41; 162/42; 162/60; 162/68; 162/78

(58) Field of Classification Search ..... 162/41–47, 162/56, 68, 78, 60
See application file for complete search history.

(56) References Cited

U.S. PATENT DOCUMENTS 2,920,011 A * 1/1960 Eilers, Jr. ..... 162/78
3,193,445 A 7/1965 Parker et al.
3,251,731 A 5/1966 Gard
3,492,199 A 1/1970 Kindron et al.
3,507,744 A 4/1970 Grangaard
3,650,887 A 3/1972 Grangaard
3,944,463 A 3/1976 Samuelson et al.
4,022,654 A 5/1977 Engstrom et al.
4,160,693 A * 7/1979 Lindahl et al. ..... 162/24
4,259,150 A 3/1981 Prough
4,294,653 A * 10/1981 Lindahl et al. ..... 162/25
4,311,553 A 1/1982 Akerlund et al.
4,400,237 A 8/1983 Kruger et al.
4,402,788 A 9/1983 Paulose et al.
4,410,397 A 10/1983 Kempf (Continued)

FOREIGN PATENT DOCUMENTS

EP 0 919 661 * 6/1999

OTHER PUBLICATIONS

G.A. Smook, Handbook for Pulp & Paper Technologists, 1982, TAPPI, p. 198.*

(Continued)

*Primary Examiner*—Eric Hug
(74) *Attorney, Agent, or Firm*—Finnegan, Henderson, Farabow, Garrett & Dunner LLP

(57) ABSTRACT

A process for high temperature peroxide bleaching of pulp in which pulp is retained at high temperature and pressure to increase bleaching activity but in which the pulp is cooled prior to discharge from the pressure vessel below the flash point thereby resulting in lower energy, nonviolent discharge. Through the use of a heat exchanger, the cooling of the pulp can be performed using recycled filtrate containing residual peroxide, which encourages further bleaching during atmospheric retention. The heat exchanger is also used to heat a water stream, which can be used earlier in the pulping process, resulting in cost savings because energy within the system is retained to a greater degree.

58 Claims, 2 Drawing Sheets

U.S. PATENT DOCUMENTS 4,427,490 A 1/1984 Eckert
4,450,044 A 5/1984 Fritzvold et al.
4,595,456 A * 6/1986 Andersson ..... 162/47
4,626,319 A 12/1986 Kruger et al.
4,661,205 A 4/1987 Ow et al.
4,689,117 A 8/1987 Villavicencio
4,732,650 A 3/1988 Michalowski et al.
4,734,160 A 3/1988 Moldenius
4,734,161 A 3/1988 Dubreux
4,756,798 A 7/1988 Lachenal et al.
4,756,799 A 7/1988 Bengtsson et al.
4,798,651 A 1/1989 Kokta
4,804,440 A 2/1989 Liebergott et al.
4,826,567 A 5/1989 Gratzl
4,834,837 A * 5/1989 Loquenz et al. ..... 162/19
4,915,785 A 4/1990 Siminoski et al.
4,975,204 A * 12/1990 Henricson et al. ..... 210/785
5,118,389 A 6/1992 Dubelsten et al.
5,143,581 A 9/1992 Devic
5,169,495 A 12/1992 Lachenal
5,211,809 A 5/1993 Naddeo et al.
5,223,091 A 6/1993 Hetzler et al.
5,277,760 A * 1/1994 Fongen ..... 162/6
5,296,100 A 3/1994 Devic
5,298,118 A 3/1994 Devic
5,306,392 A 4/1994 Mita
5,310,458 A 5/1994 Lundgren et al.
5,401,360 A 3/1995 Galland
5,401,362 A * 3/1995 Lindberg ..... 162/37
5,540,816 A 7/1996 Andtbacka et al.
5,571,377 A 11/1996 Tibbling et al.
5,620,563 A 4/1997 Chen
5,658,429 A 8/1997 Andersson et al.
5,698,075 A 12/1997 Troughton et al.
5,733,412 A 3/1998 Markham et al.
5,755,925 A 5/1998 Kogan et al.
5,755,926 A 5/1998 Hankins et al.
5,766,414 A 6/1998 Alenius et al.
5,766,415 A 6/1998 Chen
5,785,812 A 7/1998 Linsten et al.
5,855,622 A 1/1999 Takeuchi
5,858,170 A 1/1999 Carlsson et al.
5,885,412 A 3/1999 Paart et al.
5,900,111 A 5/1999 Nystrom et al.
5,916,415 A 6/1999 Miller
5,958,179 A 9/1999 Gehr et al.
5,980,689 A * 11/1999 Germgard ..... 162/29
5,997,689 A 12/1999 Bokstrom
6,106,667 A * 8/2000 Henricson ..... 162/37
6,136,145 A * 10/2000 Henricson et al. ..... 162/47
6,153,300 A 11/2000 Stromberg et al.
6,221,207 B1 * 4/2001 Forslund et al. ..... 162/47
6,491,787 B2 * 12/2002 Peltonen et al. ..... 162/52
6,743,332 B2 * 6/2004 Haynes et al. ..... 162/78
6,746,568 B1 * 6/2004 Terelius et al. ..... 162/38
6,824,646 B2 * 11/2004 Izumi et al. ..... 162/38

OTHER PUBLICATIONS

Patrick Fitzgerald, "ECF Riding High: ECF Appears to Have Won its Battle Against TCF and is Poised to Become the Dominant Bleaching Technology in North America", Nov. 6, 1995, Chemical Marketing Reporter; found at http://web.archive.org/web/20030828023558/http://aet.org/reports/articles/1995/NEWS31.html, updated Aug. 28, 2003.*

* cited by examiner

*Process Flow Diagram*

*Process Flow Diagram*

PROCESS FOR HIGH TEMPERATURE PEROXIDE BLEACHING OF PULP WITH COOL DISCHARGE

DESCRIPTION

The present invention relates to a process for the bleaching of wood pulp. More specifically, the present invention relates to high temperature peroxide bleaching of pulp. Even more specifically, the present invention relates to the high temperature peroxide bleaching of pulp in which the heated pulp is cooled below the flash point using recycled cooled filtrate prior to discharge.

During processing, wood pulp is routinely bleached in order to remove compounds that color the pulp and therefore increase the whiteness of the end product. Various bleaching agents have been used in these procedures, with varying levels of success. Traditionally, chlorine-based bleaching agents have been used, but they have recently fallen into disfavor due to environmental concerns.

As a replacement for chlorine-based bleaching agents, hydrogen peroxide has been used. However, bleaching with hydrogen peroxide has its drawbacks, because the bleaching effect is not as strong as with chlorine-based bleaches.

To counter the decreased bleaching effect of hydrogen peroxide, various solutions have been proposed. Activating agents have been added to the hydrogen peroxide/pulp slurry in order to increase the bleaching action; however, activating agents, like chlorine based bleaches, may have environmental consequences as well. Simply using greater amounts of hydrogen peroxide in the bleaching process does not solve the problem since merely increasing the amount of hydrogen peroxide results in large amounts of hydrogen peroxide remaining unreacted and therefore wasted.

As an alternative approach to merely increasing the hydrogen peroxide amounts, two-stage or even three-stage bleaching processes have been proposed in an effort to expose the pulp to a greater amount of hydrogen peroxide. Such systems are necessarily more costly and more complex to operate than single-stage bleaching systems.

Hydrogen peroxide efficiency can also be improved by increasing the temperature and pressure of the pulp during its contact with the hydrogen peroxide; however, processing becomes more difficult at higher temperatures. As the temperature of the pulp is increased, the pressure within the pressure vessel is generally also increased in order to prevent the pulp from flashing. In order to discharge the highly pressurized and heated pulp from the pressure vessel, a blow off discharge valve is used which results in flashing.

The present invention overcomes one or more of the difficulties associated with the prior art. Specifically, the present invention is a novel process for bleaching pulp at temperatures at or above the atmospheric flash point. Bleaching at these temperatures improves the bleaching effect and allows more thorough use of peroxide. Further, through the recycling of filtrate containing residual peroxide, more complete use of the peroxide is obtained.

According to one embodiment, through the use of a heat exchanger and a cooled recycle filtrate stream from the bleaching process, the present invention may increase one or more of the efficiency, effectiveness, and safety of high temperature peroxide bleaching procedures. By using a heat exchanger, the press filtrate exiting the system may be cooled and recycled for introduction into the system. This cooled filtrate stream may be used to cool the pulp present in the pressure vessel to below its flash point just prior to discharge. Furthermore, the heat exchanger simultaneously heats a water stream, which can then be used in this process or in an associated process to improve energy efficiency. This heat exchange system reduces the loss of heat in the system, therefore improving overall system efficiency.

According to one embodiment, the present invention provides a process for the peroxide bleaching of wood pulp at temperatures at or above the atmospheric flash point.

According to another embodiment, the present invention cools the pulp below the flash point while at the same time maintaining peroxide concentration through the use of cooled recycled filtrate.

According to still another embodiment, the present invention retains heat within the bleaching system through the use of a heat exchanger to cool the recycled filtrate. The heat obtained from the heat exchanger may be used to heat a water stream for use in heating unbleached pulp, or in other manners.

According to one embodiment, the present invention provides a bleaching process that is safer than traditional processes, and is more environmentally friendly than chlorine-based processes.

According to one embodiment of the present invention, there is provided a process for high temperature peroxide bleaching of wood pulp including, providing a wood pulp; adding to the pulp compositions for bleaching; and cooling the retained pulp to a temperature below the flash point of the pulp using a cooled, recycled filtrate.

Cooling the retained pulp before discharge may prevent flashing or violent discharge from the retention tank, thereby improving the resulting fiber quality. The lack of a flashing discharge coupled with no need for heavy-duty discharge valves can increase the safety of the bleaching operation.

According to one embodiment of the invention, the brightness of the bleached pulp may be increased due to the higher retention temperature. According to another embodiment, the chemical consumption of the process can be decreased because of the recycling of unreacted peroxide in the filtrate.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION

Figure 1:
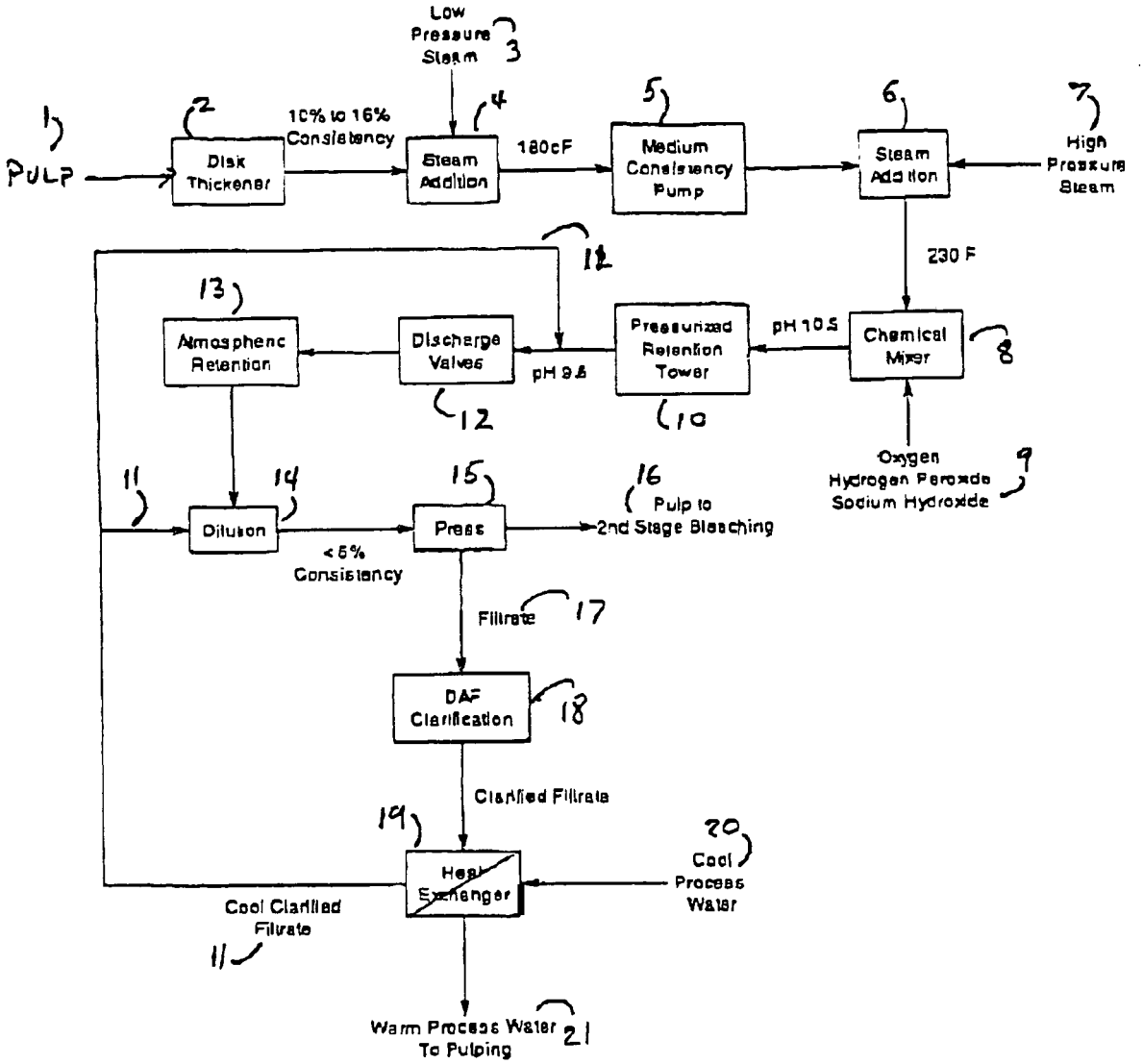
FIG. 1 is a schematic of one embodiment of the disclosed process in which the filtrate is recycled after being cooled in a heat exchanger.

Reference will now be made in detail to specific embodiments of the invention, examples of which are illustrated in the accompanying drawings. In the embodiment described in FIG. 1, pulp (1) is introduced to the system and is first passed through a disk thickener (2). The disk thickener increases the solids content of the pulp. According to one embodiment, the solids content of the pulp is increased to greater than about 10%. According to another embodiment, the solids content of the pulp is increased to greater than about 12%. According to yet another embodiment, the solids content of the pulp is increased to range of from about 14% to about 16%.

Low pressure steam (3), at or above about 15 p.s.i.g., is then added in a steam addition step (4) to raise the temperature of the pulp to a range of about 180° F. to about 212° F. A medium consistency pump (5) then is used to raise the pressure of the pulp. The discharge pressure of the pump (5) may be from about 100 p.s.i.g. to about 125 p.s.i.g., and the pulp may have a consistency of about 6% to about 20%. A second steam addition step (6) adds high pressure steam (7), at or above about 100 p.s.i.g., to further raise the temperature of the pulp. According to one embodiment of the present invention, the high pressure steam is introduced in the second steam addition step at an appropriate pressure, for example, about 140 p.s.i.g. Moreover, according to one embodiment of the present invention, the second steam addition raises the temperature of the pulp to or above about 212° F. According to another embodiment, the temperature is raised to above about 220° F. According to yet another embodiment, the temperature is raised to above about 230° F.

The pulp is then passed through a chemical mixer (8), which adds compositions for bleaching (9) to raise the pH of the pulp to above about 10. According to another embodiment, the pH is raised into the range of about 10.0 to about 11.0. According to yet another embodiment of the invention, the pH is raised into the range of about 10.4 to about 10.6. In still another embodiment, the pH is raised to about 10.5. The point of addition of hydrogen peroxide may be selected by the skilled artisan and is generally selected to forestall loss of peroxide. The pulp is then retained in a pressurized retention tower (10) for a time sufficient to permit bleaching and at a pressure sufficient to prevent flashing.

Prior to discharge from the pressure vessel, the pH of the pulp is reduced to between about 8 and about 10; and the pulp is mixed with cool clarified filtrate and cooled to a temperature below the atmospheric flash point. The pulp can then be discharged from the pressure vessel using discharge valves (12). According to one embodiment of the present invention, the pulp is cooled primarily using a cool clarified filtrate (11).

According to one embodiment of the invention, after discharge, additional cool clarified filtrate (11) can be introduced to further cool and dilute the pulp (14). The cooled clarified filtrate may reintroduce residual bleaching compositions to the pulp, thereby resulting in further bleaching. According to one embodiment of the invention, if additional bleaching compositions are introduced, either from a cooled clarified filtrate or from stock, the solids content of the pulp is retained as high as possible to ensure maximum benefit from the available bleaching compositions. When appropriate, the pulp may optionally be retained further at atmospheric pressure (13).

After dilution, the pulp will have a consistency selected, as appropriate, to address issues associated with further processing of the pulp. For example, the pulp may be diluted to levels appropriate for processing through other apparatus, including but not limited to, a pump or press. According to one embodiment, the pulp may have a consistency of less than about 10% solids content. According to another embodiment, the pulp will have a consistency less than about 8% solids. In yet another embodiment, the pulp will have a consistency of less than about 5% solids. According to another embodiment of the invention, the pulp will have a consistency less than about 2% solids.

The cooled, diluted pulp may then be dewatered using a press (15) to obtain a pulp (16) which can then be further bleached or otherwise processed. A filtrate (17) is also obtained from the press. The filtrate may then be clarified. Clarifying may be carried out using any art recognized method, for example, through the use of a dissolved air type clarifier (18).

The hot clarified filtrate is then passed through a heat exchanger (19) to remove heat and produce a cool clarified filtrate (11) which can then be recycled for further use in the system. The heat removed from the filtrate can be used to heat a cool process water stream (20), producing a warm process water stream (21) which can be used in further pulping operations, e.g., washing, bleaching, etc.

Figure 2:
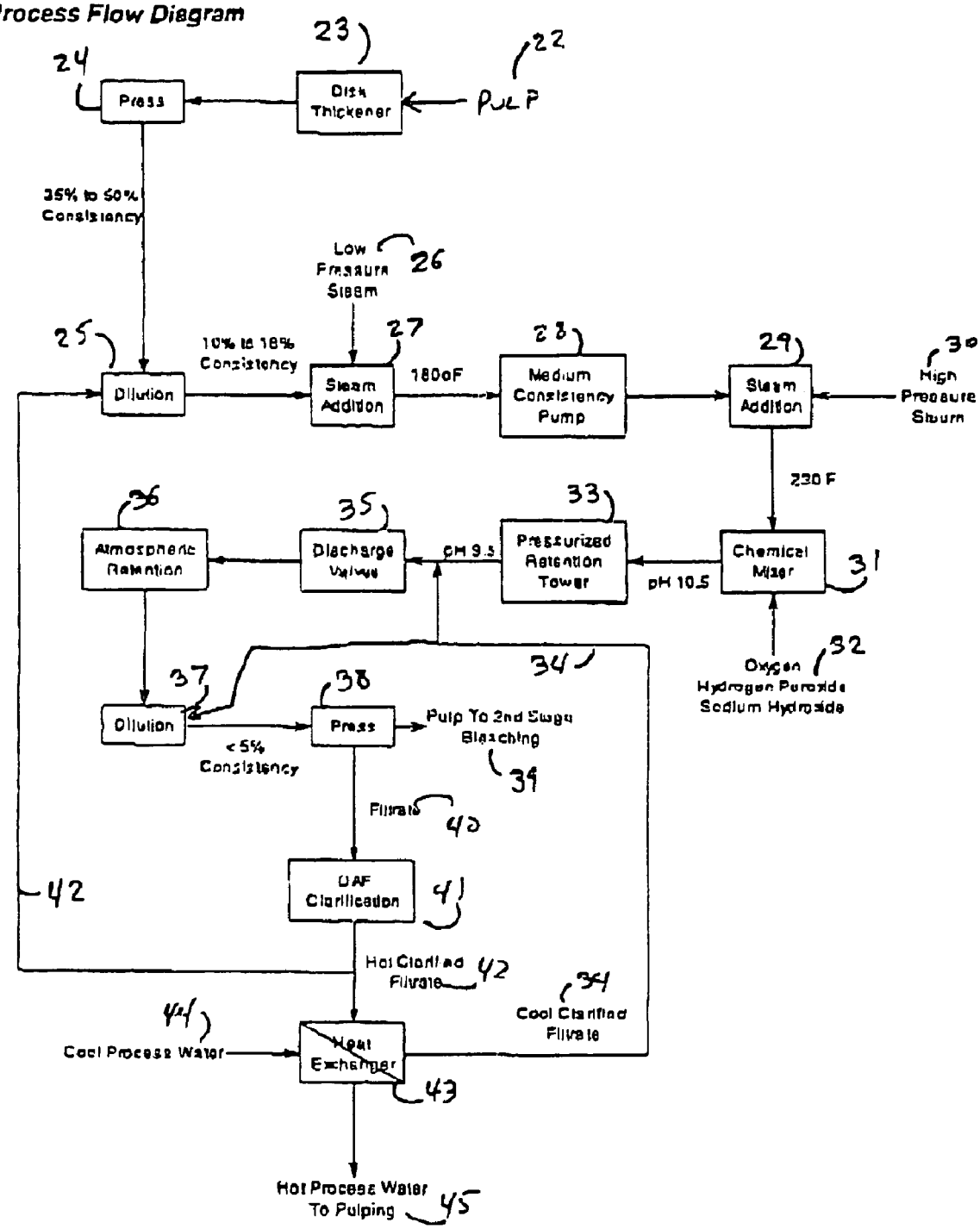
FIG. 2 is a schematic of another embodiment of the disclosed process in which some of the filtrate is recycled prior to being cooled, while the remainder of the filtrate is cooled and then recycled.

An alternative embodiment of the invention is illustrated by way of FIG. 2. Pulp (22) is introduced to the system and is first passed through a disk thickener (23) and then a press (24) in order to raise the solids content of the pulp to a range of about 35% to about 50%.

The pulp is then heated and diluted (25) using hot clarified filtrate (42), which reduces the solids content, but not below about 10%. According to another embodiment, the hot clarified filtrate reduces the solids content to not less than about 12%. According to yet another embodiment, the hot clarified filtrate reduces the solids content into the range of about 14% to about 16%. The addition of hot clarified filtrate also raises the temperature of the pulp to above about 150° F.

Low pressure steam (26), at or above about 15 p.s.i.g., is then added in a steam addition step (27) to raise the temperature of the pulp to a range of about 180° F. to about 212° F. A medium consistency pump (28) then is used to raise the pressure of the pulp. The discharge pressure of the pump (28) may be from about 100 p.s.i.g. to about 125 p.s.i.g., and the pulp may have a consistency of about 6% to about 20%. A second steam addition step (29) adds high-pressure steam (30) to further raise the temperature of the pulp. According to one embodiment of the invention, the second steam addition raises the temperature of the pulp to or above about 212° F. According to this embodiment, the temperature may be raised by the second steam addition to or above about 220° F. According to another embodiment of the invention, the second steam addition can raise the temperature to or above about 230° F.

The pulp is then passed through a chemical mixer (31) which adds compositions for bleaching (32) to raise the pH of the pulp above about 10. According to another embodiment, the pH is raised into the range of about 10.0 to about 11.0. According to another embodiment of the invention, the pH is raised into the range of about 10.4 to about 10.6. In yet another embodiment, the pH is raised to about 10.5. The pulp is then retained in a pressurized retention tower (33) for a time sufficient to permit bleaching and at a pressure sufficient to prevent flashing.

Prior to discharge from the pressure vessel, the pulp is cooled. The pulp is cooled to a temperature below the atmospheric flash point and the pH is reduced. According to one embodiment, the pH is reduced to at or below about 9.5. The pulp can then be discharged from the pressure vessel using discharge valves (35). According to one embodiment of the present invention, the pulp is cooled using a cool clarified filtrate (34).

According to one embodiment of the invention, after discharge, additional cool clarified filtrate (34) can be introduced to further cool and dilute the pulp (37). The cooled clarified filtrate may reintroduce residual bleaching compositions to the pulp, thereby resulting in further bleaching.

According to one embodiment of the invention, if additional bleaching compositions are introduced, either from a cooled clarified filtrate or from stock, the solids content of the pulp is retained as high as possible to ensure maximum benefit from the available bleaching compositions. When appropriate, the pulp may optionally be retained further at atmospheric pressure (36).

After dilution, the pulp will have a consistency selected, as appropriate, to address issues associated with further processing of the pulp. For example, the pulp may be diluted to levels appropriate for processing through other apparatus, including but not limited to, a pump or press. According to one embodiment, the pulp may have a consistency of less than about 10% solids content. According to another embodiment, the pulp will have a consistency less than about 8% solids. In yet another embodiment, the pulp will have a consistency of less than about 5% solids. According to another embodiment of the invention, the pulp will have a consistency less than about 2% solids.

The cooled, diluted pulp is then dewatered using a press (38) to obtain a pulp (39) which can then be further bleached or otherwise processed. A filtrate (40) is also obtained from the press. The filtrate may then be clarified, for example through the use of a dissolved air type clarifier (41).

A portion of the hot clarified filtrate (42) is then passed through a heat exchanger (43) to remove heat and produce a cool clarified filtrate (34) which can then be recycled for further use in the system. The heat removed from the filtrate can be used to heat a cool process water stream (44), producing a warm process water stream (45) which can be used in further pulping operations, e.g., washing, bleaching, etc.

Pulps for use according to the present invention include any art recognized pulps, including, but not limited to, chemical pulps and/or mechanical (lignin containing) pulps. Pulps may be selected from the pulps of softwoods and/or hardwoods, and may include primary (virgin) fibers, secondary (recycled) fibers, or mixtures thereof.

Typically the pulp for use in the present invention has previously undergone deinking and pulping. However, other pretreatments may also be applied, including, but not limited to, mechanical kneading or dispersion of the inks, screening, cleaning, and chemical treatments with surfactants or enzymes. While the bleaching process of the present invention may be incorporated at any point in the pulping process, according to one embodiment, the bleaching is carried out immediately after deinking of the pulp. Removal of contaminants that interfere with the bleaching process result in higher bleaching efficiencies.

The pulp entering the bleaching process is typically at a consistency unsuitable for bleaching. The entering pulp consistency can be as low as 1%. Any art recognized process for increasing pulp consistency can be used in the present invention. Appropriate processes for increasing consistency will be readily apparent to the skilled artisan.

In one embodiment according to the present invention, a thickener may be used to increase the pulp thickness to a level suitable for bleaching. In an alternate embodiment of the invention, the pulp may be thickened mechanically using any type of commercial thickening device. In one embodiment, a disk thickener is used to increase the solids content of the pulp, however disk filters, drum decker/thickeners, or presses (screw, roll, or belt type) may also be used. The thickening device may also be a pulp washer with discharge consistency above about 10% solids. Regardless of the method of thickening, the solids content of the pulp is, according to one embodiment, raised to a solids content above about 10%. According to another embodiment, the solids content is raised to above about 12%. In yet another embodiment, the solids content is raised into the range of about 14% to about 16%.

In one embodiment, at any point before addition of compositions for bleaching, a chelant may be added to the pulp to prevent scaling (depositing of solid inorganic solutes onto surfaces) in subsequent steps and reduce peroxide decomposition. Suitable chelants can be selected from any art recognized chelant. Chelants include any art recognized sequestering agent including, but not limited to, diethylenetriaminepentamethylenephosphonic acid (DTMPA), diethylenetriaminepentaacetic acid pentasodium salt (DTPA) and/or ethylenediaminetetraacetic acid tetrasodium salt (EDTA).

According to one embodiment of the invention, the pulp may be heated to a suitable temperature prior to bleaching. Alternatively, the pulp entering the bleaching process may have been pre-heated during other processing steps. According to one embodiment, the pulp is heated to a temperature at or above about 180° F. According to another embodiment, the pulp is heated to a temperature at or above about 212° F. According to yet another embodiment, the pulp is heated to a temperature at or above about 220° F. In still another embodiment, the pulp is heated to a temperature at or above about 230° F. Heating may be carried out using any art-recognized heating means. In one embodiment according to the present invention, steam may be used to heat the pulp, since it can be used without substantially diluting the pulp.

Heating may be carried out in a single stage or in multiple stages, but is typically performed in a variety of stages at increasing pressure levels in order to prevent flashing. By way of example, the pulp may first be heated to about 180° F. at atmospheric pressure using low pressure steam, then pressurized using a medium consistency pump followed by heating to about 230° F. using high pressure steam.

In order to bleach the pulp, art-recognized bleaching compositions are added to the wood pulp either before, after, or during heating. Compositions which may be introduced to the pulp for bleaching include hydrogen peroxide, and may include other bleaching agents including but not limited to, one or more of alkali hydroxide, gaseous oxygen, ozone, and peroxygen compounds (including, but not limited to, peracetic and peroxymonosulfuric acid). The bleaching agents may further include reductive agents (including, but not limited to, formadmidine sulfinic acid (FAS), hydroxymethane sulfinic acid (HAS), sodium borohydride, and sodium hydrosulfite), and mixtures thereof. In one embodiment according to the present invention, hydrogen peroxide, sodium hydroxide, and gaseous oxygen are all added to the pulp for bleaching. Optionally, catalyzing or activating agents may be added.

The compositions and pulp are mixed together to provide sufficient contact. According to one embodiment of the present invention, mixing is carried out until substantial homogeneity is reached. Mixing may be accomplished using any art recognized mixer. Appropriate mixers include devices such as high shear mixers, medium consistency pumps, pressurizable kneaders, and disk dispergers or refiners.

In one embodiment, the pH of the pulp after the addition of the bleaching compositions is maintained at a level sufficient to maintain the presence of the perhydroxyl anion ($OOH^-$) in the pulp. According to another embodiment, the pH is greater than about 10. According to another embodiment, the pH is from about 10.0 to about 11.0. According to another embodiment of the invention, the pH is in the range of about 10.4 to about 10.6. In yet another embodiment, the pH is about 10.5.

The pulp is then retained in contact with the bleaching compositions for a period sufficient to allow substantial reaction between the chemicals and the pulp. Retention may be performed in any art recognized pressure vessel. Retention may be carried out in, for example, an upflow-type retention tower. According to another embodiment, retention is performed in a pressure vessel having a discharge valve. The discharge valve may be a blow valve, but a blow valve is not required.

According to one embodiment of the invention, the temperature of the pulp during retention is maintained above the atmospheric flash point of the pulp. According to another embodiment, the temperature is maintained at or above about 212° F. In yet another embodiment, the temperature is maintained at or above about 230° F.

The pressure during retention is maintained at a level sufficient to prevent flashing and formation of oxygen bubbles. According to one embodiment, the minimum pressure during retention is maintained at or above about 12 p.s.i.g. According to another embodiment, the pressure during retention is maintained at or above about 50 p.s.i.g. Other specific temperature and pressure combinations, which may be maintained during retention, will be readily apparent to those skilled in the art.

According to one embodiment of the invention, the pulp contacts the compositions for a period of time sufficient to bleach the pulp to the degree of brightness desired. It is readily apparent to the skilled artisan that retention time is a function of temperature. The higher the temperature, the shorter the retention time may be to achieve the same result. In one embodiment, a 10-30 point improvement in brightness may be obtained, depending on the starting brightness of the pulp. According to one embodiment of the present invention, the retention time is less than about 15 minutes. According to another embodiment of the invention, the retention time is less than 5 minutes. According to yet another embodiment of the invention, the retention time is less than about one minute. According to still another embodiment, the retention time is from 0.1 to about 20 seconds.

In an alternative embodiment, the basicity of the pulp can be monitored to determine when to end retention of the pulp. The pH of the pulp mixture will decrease as the bleaching chemicals react. According to one embodiment, at the end of the bleaching the pH is from about 8 to about 10. According to still another embodiment, the pH at the end of bleaching is from about 9 to about 10. According to one embodiment, the makeup of the bleaching composition is controlled so that at the end of the bleaching, the pH will be between about 8 and 10 and from about 95 to 99% of the hydrogen peroxide will have been consumed. According to yet another embodiment, the pH will be between about 9 and 10 and between 95 and 97% of the hydrogen peroxide will have been consumed.

Prior to discharge from the pressure vessel, the pulp temperature is decreased. According to one embodiment the pulp temperature is decreased by using cooled filtrate recovered from the dewatering step and cooled in the heat exchanger. Alternatively, non-recycled water may be added to cool the pulp. According to one embodiment, the pulp is cooled below the atmospheric flash point of the pulp. The temperature may be reduced to below about 210° F. In an alternative embodiment, the temperature of the pulp is reduced to below about 200° F. In yet another embodiment, the temperature is reduced to below about 180° F.

The addition of the cooled filtrate also acts to dilute the pulp mixture. The consistency of the pulp may be reduced, however, the consistency of the pulp should be maintained at or above about 1% solids content. According to another embodiment, the pulp consistency is reduced to or above about 5%. According to yet another embodiment, the pulp consistency is reduced to or above about 8%. According to yet another embodiment, the pulp consistency is reduced to or above about 10%. Using recycled filtrate to dilute the pulp allows the concentration of bleaching compositions to be maintained at a level sufficient to allow further bleaching of the pulp.

Once sufficiently cooled, the pulp can then be discharged to atmospheric pressure. Because the temperature of the pulp is below the atmospheric flash point, this can be performed with a lightweight or light duty discharge valve system. According to one embodiment, a double valve or a cyclone may be used. Other suitable pressure release valves will be readily apparent to the skilled artisan and include, for example butterfly valves, ball port valves, V-port valves, and/or rotary port valves.

The discharged pulp may then be fed into an atmospheric retention tank sized to provide up to two hours of additional retention time, if desired. Retention at atmospheric pressure can allow further bleaching of the wood pulp. According to one embodiment, the recycled filtrate that was used to cool the pulp below the flash point allows the peroxide density during the atmospheric retention to be maintained at a higher level and increases the effectiveness of further bleaching.

The period of time at which the pulp may be retained at atmospheric pressure will be apparent to those of skill in the art. In one embodiment, the pulp may be retained at atmospheric pressure for approximately an additional two hours. Appropriate retention times will be readily apparent to the skilled artisan. Retention times may be selected so that there is minimal residual hydrogen peroxide present in the pulp at release, but still a sufficient amount to minimize brightness reversion. Appropriate times and amounts are within the purview of the skilled artisan.

According to one embodiment, the residual hydrogen peroxide at release is at or above about 1% of the original charge. According to another embodiment, the residual hydrogen peroxide at release is between about 3% and about 5% of the original charge. The desired amount of residual hydrogen peroxide may be derived as a proportion of residual sodium hydroxide. The ratio of residual hydrogen peroxide to residual sodium hydroxide may be in the range of 10:1 to 1:10. According to another embodiment, the ratio is about 1:1.

In one embodiment, further cooled recycled press filtrate can be added to further dilute the pulp prior to dewatering. According to another embodiment, the pulp is diluted to below about 5% solids content to allow the pulp to be pumped to a dewatering or washing device. Additionally, such dilution allows more efficient removal of residual chemicals during later dewatering.

The pulp is then dewatered to a level sufficient to prevent carryover of peroxide to any subsequent stage of processing. According to one embodiment, the pulp is dewatered to at least about 35% discharge solids. According to yet another embodiment, the pulp is dewatered to at least about 50% solids.

Dewatering may be accomplished with any chemical or mechanical thickener or washer known to those in the art, including but not limited to those previously mentioned. In one embodiment, a standard twin wire or screw type press is used to dewater and thicken the pulp.

Further processing steps may be performed on the pulp after completing the bleaching process described in the present invention. For example, the pulp may be further bleached in a reductive bleaching stage using compounds such as FAS or sodium hydrosulfite to decolorize dyes present in the pulp.

The filtrate recovered during the dewatering step can be clarified prior to recycling. Clarification may be performed to remove excess solids or ash in the filtrate stream. In another embodiment, a dissolved air type clarifier is used to remove unwanted impurities from the filtrate. Alternatively, a settling clarifier or mechanical filtering device may be used.

The filtrate may be cooled prior to recycling. According to one embodiment, the filtrate is cooled to a temperature sufficient to cool heated retained pulp below the atmospheric flash point when reintroduced to the retention vessel. The filtrate may be cooled to below about 140° F. According to another embodiment, the filtrate is cooled to below about 130° F. According to yet another embodiment, the filtrate is cooled to below about 120° F.

The filtrate may be cooled using any art-recognized method including contact with the atmosphere or with a heat exchanger. According to one embodiment, the filtrate is cooled using the heat exchanger, which is a non-contact type heat exchanger. According to another embodiment, the heat exchanger simultaneously heats a separate process water stream using the heat recovered while cooling the filtrate.

The heated process water stream from the heat exchanger may be used for further pulping operations. For example, the water stream can be used to dilute and/or pre-heat pulp wastepaper prior to bleaching. Reusing the heated water reduces the amount of energy used in the pulping process, thereby reducing the amount of energy consumed by the system and making the system more efficient. This also results in a cost savings.

In an alternative embodiment of the invention, a portion of the hot filtrate from the dewatering step is not passed through the heat exchanger in order to cool the filtrate. Instead, the hot filtrate is recycled and used to heat the pulp prior to bleaching.

The use of hot filtrate to heat the pulp also dilutes the pulp. Unless the pulp is substantially thickened prior to hot filtrate addition, the resulting pulp mixture will be a consistency below that expected for optimum bleaching. Therefore, in the alternative embodiment, after the pulp is introduced into the system and thickened with a disk thickener, an added step using a press (such as a screw or belt type press) further thickens the pulp. Alternatively, the pulp may be thickened after addition of the hot filtrate.

The pulp is thickened to a level such that the addition of hot filtrate dilutes the pulp to a level suitable for bleaching. According to one embodiment of the invention, the pulp is thickened to a consistency of at least about 35%. According to another embodiment, the pulp is thickened to a consistency of at least about 50%. Due to the thickening, the addition of the hot filtrate therefore does not dilute the pulp below a solids content of about 10%.

The addition of the hot clarified filtrate can be used to heat the pulp to a temperature of up to about 150° F. prior to the addition of steam. Because the pulp is already at a high temperature, less steam can be used resulting in additional cost savings.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A process for bleaching cellulosic pulp, comprising:

providing a stream of cellulosic pulp;

adding to the stream of cellulosic pulp at least one composition for bleaching;

bleaching the stream of cellulosic pulp in a pressure vessel at a temperature at or above about 212° F. and the atmospheric flash point of the cellulosic pulp to form a stream of bleached cellulosic pulp;

cooling the stream of bleached cellulosic pulp prior to discharge from the pressure vessel by adding at least a portion of a cooled filtrate stream to the stream of bleached cellulosic pulp to form a cooled stream of bleached cellulosic pulp that is at a temperature below the atmospheric flash point of the bleached cellulosic pulp, dewatering the cooled stream of bleached cellulosic pulp to obtain a bleached cellulosic pulp residue stream and a hot filtrate stream; and forming the cooled filtrate stream by cooling the hot filtrate stream.

2. The process of claim 1, wherein the cellulosic pulp is chosen from at least one of chemical pulps and mechanical pulps.

3. The process of claim 1, wherein the cellulosic pulp is chosen from at least one of hardwood pulps and softwood pulps.

4. The process of claim 1, wherein the cellulosic pulp is chosen from at least one of primary fibers and secondary fibers.

5. The process of claim 1, wherein providing the cellulosic pulp is preceded by pretreating the cellulosic pulp.

6. The process of claim 5, wherein the pretreating step is deinking and wherein the bleaching occurs following deinking.

7. The process of claim 1, wherein said cellulosic pulp is thickened prior to bleaching.

8. The process of claim 7, wherein the cellulosic pulp is thickened using a disk thickener.

9. The process of claim 7, wherein the cellulosic pulp is thickened prior to bleaching to a solids content above about 10%.

10. The process of claim 1, wherein a chelant is added to the cellulosic pulp.

11. The process of claim 10, wherein the chelant is chosen from at least one of diethylenetriaminepentamethylenephosphonic acid (DTMPA), diethylenetriaminepentaacetic acid pentasodium salt (DTPA), and ethylenediaminetetraacetic acid tetrasodium salt (EDTA).

12. The process of claim 1, wherein the cellulosic pulp is a heated wood pulp.

13. The process of claim 1, wherein providing a cellulosic pulp is followed by heating the cellulosic pulp.

14. The process of claim 12, wherein the cellulosic pulp is heated to above about 212° F.

15. The process of claim 12, wherein steam is used to heat the cellulosic pulp.

16. The process of claim 15, wherein the heating step is comprised of the steps of:

injecting low pressure steam at atmospheric pressure;

increasing the pressure of the cellulosic pulp to above atmospheric pressure; and injecting high pressure steam at raised pressure.

17. The process of claim 16, wherein the injection of low pressure steam raises the cellulosic pulp temperature to above about 180° F.

18. The process of claim 16, wherein the pressure is increased using a medium consistency pump.

19. The process of claim 16, wherein the injection of high pressure steam raises the cellulosic pulp temperature to above about 230° F.

20. The process of claim 1, wherein said at least one composition for bleaching comprises in addition to hydrogen peroxide, at least one of the following: gaseous oxygen, alkali hydroxide, ozone, and peroxygen compounds.

21. The process of claim 20, wherein said at least one composition for bleaching comprises gaseous oxygen, hydrogen peroxide, and sodium hydroxide.

22. The process of claim 1, wherein the adding is followed by mixing the chemicals and cellulosic pulp.

23. The process of claim 1, wherein the pH of the cellulosic pulp after the addition of the at least one composition for bleaching is from about 10.0 to about 11.0.

24. The process of claim 1, wherein adding at least one composition for bleaching is followed by retaining the cellulosic pulp.

25. The process of claim 24, wherein the cellulosic pulp is retained in a pressurized vessel operationally connected to a discharge valve.

26. The process of claim 24, wherein the cellulosic pulp is retained at a temperature above the atmospheric flash point of the cellulosic pulp.

27. The process of claim 26, wherein the cellulosic pulp is retained at a temperature above about 230° F.

28. The process of claim 24, wherein the cellulosic pulp is retained at a pressure sufficient to prevent flashing.

29. The process of claim 28, wherein the cellulosic pulp is retained at a pressure above about 12 p.s.i.g.

30. The process of claim 29, wherein the cellulosic pulp is retained at a pressure above about 50 p.s.i.g.

31. The process of claim 24, wherein the pH of the cellulosic pulp after the retention is between about 8 and about 10.0.

32. The process of claim 1, wherein the hot filtrate stream is cooled using a heat exchanger to obtain the cooled filtrate stream.

33. The process of claim 1, wherein the cellulosic pulp is cooled to below about 210° F.

34. The process of claim 1, wherein the cooled stream of bleached cellulosic pulp is discharged to atmospheric pressure.

35. The process of claim 34, wherein the cellulosic pulp is discharged through a first discharge valve.

36. The process of claim 35, wherein subsequent to the discharge through said first discharge valve, the cellulosic pulp passes through a second discharge valve and cyclone.

37. The process of claim 34, wherein discharging the cellulosic pulp to atmospheric pressure is followed by retaining the cooled cellulosic pulp at atmospheric pressure.

38. The process of claim 37, wherein the cellulosic pulp is retained at atmospheric pressure for less than about two hours.

39. The process of claim 37, wherein the residual hydrogen peroxide after atmospheric retention is at or above about 1% the original charge.

40. The process of claim 1, wherein prior to the dewatering, the cellulosic pulp is diluted to below about 5% solids.

41. The process of claim 40, wherein the cellulosic pulp is diluted prior to dewatering using cooled filtrate.

42. The process of claim 1, wherein the cellulosic pulp is dewatered to a consistency above about 35% discharge solids.

43. The process of claim 1, wherein the cellulosic pulp is dewatered using a mechanical thickener.

44. The process of claim 1, wherein the dewatering is followed by clarifying the hot filtrate.

45. The process of claim 1, further comprising the steps of:

after the dewatering, clarifying the hot filtrate, cooling the clarified hot filtrate to obtain a cooled filtrate; and recycling the cooled filtrate for use in cooling the cellulosic pulp.

46. The process of claim 45, wherein cooling the hot filtrate reduces the temperature of the filtrate below about 140° F.

47. The process of claim 45, wherein cooling the hot filtrate is carried out using a heat exchanger.

48. The process of claim 47, wherein the heat exchanger comprises a non-contact type heat exchanger.

49. The process of claim 47, further comprising the steps of:

heating a process water stream with heat obtained from the heat exchanger; and, recycling the heated process water stream.

50. The process of claim 1, further comprising the steps of:

after providing a cellulosic pulp, thickening the cellulosic pulp;

after thickening the cellulosic pulp, diluting and heating the cellulosic pulp using hot filtrate; and after dewatering the cooled stream of bleached cellulosic pulp, recycling a portion of the hot filtrate for In diluting and heating the cellulosic pulp.

51. The process of claim 50, wherein the cellulosic pulp is thickened to a solids content of at least about 35%.

52. The process of claim 50, wherein the solids content of the cellulosic pulp alter dilution is above about 10%.

53. The process of claim 50, wherein the cellulosic pulp is heated using hot filtrate to a temperature of up to about 150° F.

54. A process for bleaching cellulosic pulp, comprising:

providing a cellulosic pulp;

heating the cellulosic pulp, wherein the heating comprises the steps of:

injecting steam at atmospheric pressure;

increasing the pressure of the cellulosic pulp to above atmospheric pressure; and injecting high pressure steam at raised pressure;

adding to the cellulosic pulp at least one composition for bleaching comprising at least hydrogen peroxide;

mixing the at least one composition and cellulosic pulp;

retaining the cellulosic pulp in a pressure vessel in a pressurized state at or above about 212° F. and the atmospheric flash point of the cellulosic pulp;

cooling the cellulosic pulp prior to discharge from the pressure vessel to a temperature below the atmospheric flash point of the cellulosic pulp using a cooled filtrate;

discharging the cellulosic pulp to a substantially reduced pressure;

retaining the cellulosic pulp at said reduced pressure;

further diluting the cellulosic pulp using the cooled filtrate;

dewatering the cellulosic pulp with a press to obtain a dewatered cellulosic pulp and a hot filtrate;

clarifying the hot filtrate;

cooling the hot filtrate using a heat exchanger to obtain the cooled filtrate;

recycling the cooled filtrate for use in cooling and diluting the cellulosic pulp;

heating a process water stream with heat obtained from the heat exchanger; and recycling the heated process water stream.

55. A process for bleaching cellulosic pulp, comprising:

providing a cellulosic pulp;

thickening the cellulosic pulp using a disk thickener;

further thickening the cellulosic pulp using a press;

after thickening the cellulosic pulp, diluting and heating the cellulosic pulp using a recycled hot filtrate;

further heating the cellulosic pulp, wherein the heating comprises the steps of:

injecting low pressure steam at atmospheric pressure;

increasing the pressure of the cellulosic pulp to above atmospheric pressure; and injecting high pressure steam at raised pressure;

adding to the cellulosic pulp at least one composition for bleaching comprising hydrogen peroxide;

mixing the at least one composition and the cellulosic pulp;

retaining the cellulosic pulp in a pressure vessel in a pressurized state;

bleaching the cellulosic pulp in the pressurized state at a temperature at or above about 212° F. and the atmospheric flash point of the cellulosic pulp;

cooling the cellulosic pulp prior to discharge from the pressure vessel to a temperature below the atmospheric flash point of the cellulosic pulp using a cooled filtrate;

discharging the cellulosic pulp to atmospheric pressure;

retaining the cellulosic pulp at atmospheric pressure;

further diluting the cellulosic pulp using the cooled filtrate;

dewatering the cellulosic pulp with a press to obtain a dewatered cellulosic pulp and a hot filtrate;

clarifying the hot filtrate;

recycling a portion of the hot filtrate for use in diluting and heating the cellulosic pulp;

cooling the non-recycled hot filtrate using a heat exchanger to obtain the cooled filtrate;

recycling the cooled filtrate for use in cooling and diluting the cellulosic pulp;

heating a process water stream with heat obtained from the heat exchanger; and recycling the heated process water stream.

56. The process of claims 16, 54, or 55, wherein the high pressure steam is injected at a pressure of about 100 p.s.i.g.

57. The process of claims 16, 54, or 55, wherein the high pressure steam is injected at a pressure of about 140 p.s.i.g.

58. The process of claims 16, 54, or 55, wherein the high pressure steam is injected at a pressure greater than the discharge pressure of the cellulosic pulp.

* * * * *

UNITED STATES PATENT AND TRADEMARK OFFICE

CERTIFICATE OF CORRECTION

PATENT NO. : 7,297,225 B2
APPLICATION NO. : 10/872450
DATED : November 20, 2007
INVENTOR(S) : Hazen C. Thomas et al.

It is certified that error appears in the above-identified patent and that said Letters Patent is hereby corrected as shown below:

IN THE CLAIMS:

Column 12, line 34, claim 50 — "In" should read --use in--.

Signed and Sealed this

Twentieth Day of May, 2008

JON W. DUDAS
*Director of the United States Patent and Trademark Office*